United States Patent [19]

Morris et al.

[11] Patent Number: 4,532,642

[45] Date of Patent: Jul. 30, 1985

[54] COUNTING STAMPER APPARATUS

[75] Inventors: James A. Morris; Curtis L. Hancock, both of Charlottesville; John L. Wiley, Chesapeake, all of Va.

[73] Assignee: Spectrum Manufacturing Inc., Charlottesville, Va.

[21] Appl. No.: 431,489

[22] Filed: Sep. 30, 1982

[51] Int. Cl.[3] ..... G07C 3/00

[52] U.S. Cl. ..... 377/15; 101/104

[58] Field of Search ..... 235/123, 64, 98 B; 200/61.42; 101/103, 104, 105, 405, 371; 377/15, 42, 55, 39

[56] References Cited

U.S. PATENT DOCUMENTS

| | | | |
|---|---|---|---|
| 1,684,545 | 9/1928 | Lasker | 101/78 |
| 3,101,047 | 8/1963 | Weissman | 101/103 |
| 3,344,259 | 9/1967 | Degelman | 377/55 |

*Primary Examiner*—Stanley D. Miller
*Assistant Examiner*—K. Ohralik

[57] ABSTRACT

A pressure-actuated switch mounted in the handle of a self-inking stamper is actuated by a stationary plunger assembly which extends into the handle and pressures the switch when the stamp element is moved into contact with a surface being marked. Actuation of the switch advances a counting circuit remotely located inside the lid of a lockable box. A circuit times the stamp element in the stamping position to avoid multiple markings on a single count.

22 Claims, 11 Drawing Figures

COUNTING STAMPER APPARATUS

BACKGROUND OF THE INVENTION

This invention relates generally to stamping and counting apparatus and more particularly has reference to a self-inking stamper with a foolproof counter.

At certain events, such as dances, concerts, fairs or exhibits, for which an admission charge is levied, it has long been a practice to place an identifying mark on the hand or arm of every person who has paid the admission charge so that those persons may freely leave and re-enter the facility without paying repeated admission charges. The mark is customarily applied by use of a simple stamp and ink pad.

A problem with the customary marking procedures is the inability to ensure that the persons being marked have actually paid the initial admission charge. Employees manning admission gates have been known to stamp their friends and acquaintances without collecting the admission fee from them. The problem can become quite serious at student dances and concerts or at clubs and dance halls frequented and staffed by students because the employees may be acquainted with a large number of the persons seeking admission. Large numbers of non-paying admittees causes unacceptably large financial losses for the operators and proprietors of the events.

A need thus exists for preventing non-paying admission seekers from being stamped.

The most effective means for insuring that admission gate employees do not stamp non-paying customers is to correlate the amount of money taken in by that employee with the number of stamps given out by the employee. If the number of stamps multiplied by the price of admission results in a figure which exceeds the amount of money taken in, it may be determined that the employee has admitted non-paying customers. However, it is impossible to keep an accurate count of the number of stamps given out with the customary stamping apparatus.

A need thus exists for a foolproof counting stamper which provides an accurate count of the number of stamps given out.

Examples of related counters and markers are found in U.S. and foreign patents classified in Class 116, subclasses 279, 281 and 321, Class 235, subclasses 50 R, 50 A, 92 R, 92 EL, 92 MS, 92 DE and 385, and Class 346, subclasses 42, 78, 79, 97, 105, 106, 146 and 150 of the official classifications of patents in the U.S. Patent and Trademark Office.

Examples of pertinent patents are U.S. Pat. Nos. 2,511,202; 2,548,478; 3,064,888; 3,070,297; 3,344,259; 4,048,478 and 4,122,331.

U.S. Pat. No. 3,064,888 shows a counting marker with a pen which is slidable in a handle to operate a contact switch in an upper end of the handle. The switch is connected through wires to a power supply and a remote counter. The pen may be capable of marking by light contact with the object to be marked, without sliding the pen sufficiently to activate the counter.

U.S. Pat. No. 4,048,478 describes a marking counter which may be used to count persons passing through ticket collector's gates. A marking switch is activated when a ball point cartridge slides within the casing due to marking pressure. The circuits and readouts are self-contained, which would tend to enable them to be defeated by the user. Moveover, it is possible that marking may occur through light pressure without activating the marking switch.

U.S. Pat. No. 3,344,249 shows a marking counter in which a circuit is completed through a single wire attached to the marking pen and a wire attached to the surface to be marked.

In U.S. Pat. No. 2,511,202, marking pressure upon a block pushes a plunger to make contact which signals a remote recorder. Marking may occur without sufficient pressure to close the switches.

U.S. Pat. No. 2,548,478 shows a marking pen which pivots to depress a switch completing a circuit through a wire to a remote counter. Again, it is possible that an object may be marked without sufficient force to make a count.

U.S. Pat. No. 3,070,297 discloses a complex counting device with a remote counter.

U.S. Pat. No. 4,122,331 shows a customer counting circuit which uses a floor mat switch.

As noted above, many of the known counting markers can be defeated, i.e., they can provide a mark without registering a count. Such devices would be completely useless in combating the problems described herein.

SUMMARY OF THE INVENTION

The present invention overcomes the deficiencies which exist in the prior art devices.

The present invention provides a counting stamper, and more particularly a self-inking stamper with digital counter, which pulses remote terminals upon each stamping to add one to a digital counter.

A remote counter employs a self-inking stamper. A plunger on the stationary base and ink pad portion extends upward into a handle and activates a switch near the top of the hollow handle when the handle is depressed a sufficient amount, just as the stamping block makes contact with the surface to be stamped.

The switch in the handle is connected through a coiled double wire to a plug. A circuit board mounted inside a door of a locked box has a socket for receiving the plug, a power supply, a counting circuit with reset, test count and display push-buttons, and a count display.

A circuit is provided for measuring the amount of time the stamping block remains in the stamping position. This is used to prevent a person from holding the handle in the depressed position and making repeated stampings before releasing the handle and allowing the block to return to the ink pad.

The apparatus of the present invention insures an accurate count of customers whose hands are stamped. The locked box is opened by a supervisor who displays the stored count and compares that number with the amount of admission fees collected.

Objects of the invention are, therefore, to provide improved marking and counting apparatus and to provide a foolproof counting stamper.

Another object of the invention is to provide a counting stamper which provides an accurate count of the number of stamps given out.

A further object of the invention is to provide a self-inking stamper which actuates a switch connected to a remote counting circuit to register a count whenever the stamping block is moved into the stamping position.

Another object of the invention is to provide a counting stamper wherein the counting circuit is located remote from the stamping device.

Still another object of the invention is to provide a counting stamper which prevents multiple stampings on a single count.

Yet another object of the invention is to provide a marking and counting apparatus comprising a base having a distal end for resting upon a surface to be marked and a proximal portion spaced therefrom, a marking element mounted on the base and moveable with respect thereto, means for moving the marking element, switch actuator means having a portion stationary with respect to the base when the marking element approaches the distal end of the base, a switch mounted for movement with said marking element, said switch being actuated by the actuator means whenever the marking element is moved into the distal end of the base, and counter means connected to the switch for counting the number of times the switch is actuated.

Still another object of the invention is to provide marking and counting apparatus comprising a base having an open distal end and a proximal portion extending longitudinally therefrom, a marker element mounted for reciprocal movement within the base, the base being arranged about the marking element to permit the marking element to mark a surface larger than the base only when the marking element is positioned in the distal end of the base, spring means mounted on the base for biasing the marker element into the proximal portion of the base, means for moving the marker element in opposition to the bias of said spring means to position the marker element in the distal end of the base, and means for automatically counting the number of times the marker element is moved into the distal end of the base.

These and other and further objects and features of the invention are apparent in the disclosures which includes the above and below specification and claims and drawings.

DETAILED DESCRIPTION OF THE DRAWINGS

Figure 2:
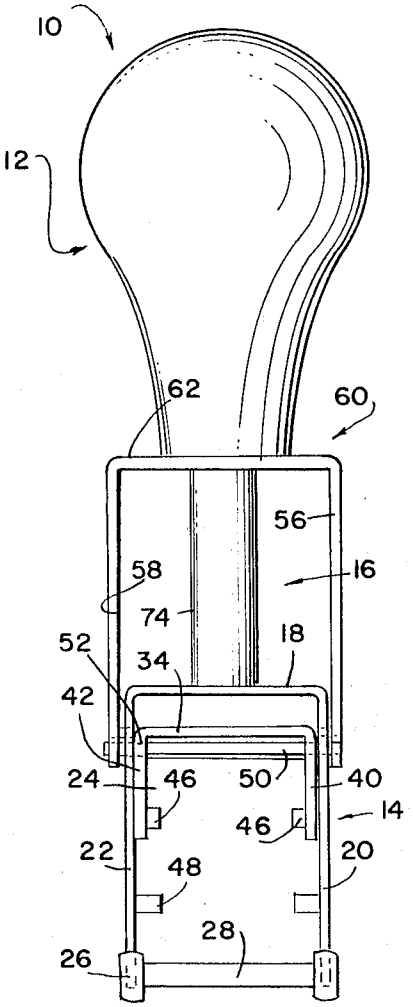
FIG. 2 is an opposite side elevational view of the stamping apparatus shown in FIG. 1A.

Referring to FIGS. 1A–1D and 2, the counting stamper of the present invention is generally indicated by the numeral 10.

The counting stamper 10 has a handle portion 12, a self-inking stamper portion 14, and a plunger assembly 16 extending between the handle portion 12 and the self-inking stamper portion 14.

Self-inking stampers, per se, are well known and the self-inking stamper portion 14 of the present invention has a fairly typical construction.

The stamper body has a proximal end defined by a rectangular end plate 18. A pair of spaced-apart side plates 20 and 22 extend longitudinally from the edges of the end plate 18 to define and open central chamber 24. The distal ends of the side plates 20 and 22 are shaped to define legs 26 constructed and arranged to rest upon a surface to be stamped. A pair of spaced-apart rods 28 and 30 extend transversely across the stamper body perpendicularly to the side plates 20 and 22 and have ends which are connected to the legs 26 immediately above the surface to be marked. The rods 28 and 30 and the distal ends of the side plates 20 and 22 define an open, generally rectangular, distal end of the stamper body.

The stamper body construction described in the preceding paragraph is designed to prevent surfaces larger than the body from entering the central chamber 24. The reasons for this will become apparent from the description of the stamping element which follows.

The stamping element has a stamp 32, typically a block formed of rubber, which is mounted on the rectangular proximal end 34 of a carriage 36. Flanges 38 extending along the lateral edges of the carriage end 34 overlie edges of the stamp 32 to secure the stamp 32 to the carriage 36. This arrangement allows the stamp 32 to be easily attached to or removed from the carriage 36, thereby facilitating interchangeability of stamps.

The carriage 36 has a pair of spaced-apart side plates 40 and 42 which extend longitudinally from the proximal end 34 along the side plate 20 and 22 of the stamper body. The distal ends of the carriage side plates 40 and 42 are formed into identical cam surfaces 44 which are specially profiled to engage pairs of longitudinally spaced-apart pins 46 and 48 which are formed along edges of the stamper body side plates 20 and 22 and which extend into the central chamber 24.

The carriage 36 is supported in the central chamber 24 by a rod 50 which extends transversely across the chamber 24. The ends of the rod 50 pass loosely through openings 52 formed in the carriage side plates 40 and 42 adjacent the carriage end 34 and loosely through longitudinally extending slots 54 formed centrally in the side plates 20 and 22 of the stamper body. The ends of the rod 50 are then connected to the distal ends of the longitudinally extending arms 56 and 58 of a U-shaped bracket 60 having a transverse base 62 attached to the distal end of the handle 12. The arms 56 and 58 are positioned outside of the stamper body side plates 20 and 22 in alignment with the longitudinal slots 54 and have lengths which are greater than the lengths of the slots 54. It will now be appreciated that movement of the handle 12 is communicated through the bracket 60 and rod 50 to the stamp carriage 36.

Movement of the stamp carriage 36 during a normal stamping operation can best be appreciated by reference to FIGS. 1A–1D consecutively.

Figure 1D:
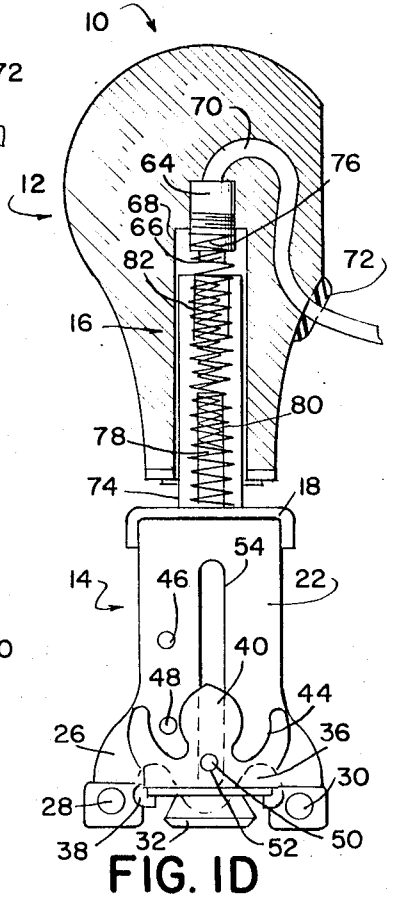
FIGS. 1A–1D are side elevational views, in section, of stamping apparatus embodying features of the present invention.
Figure 1C:
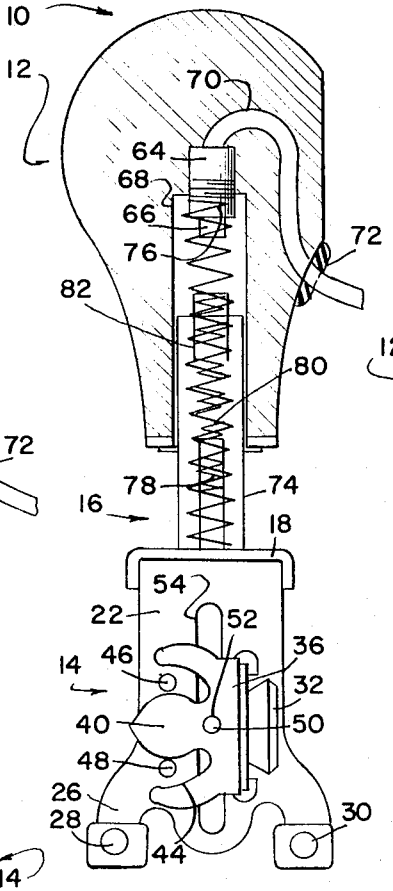
Figure 1B:
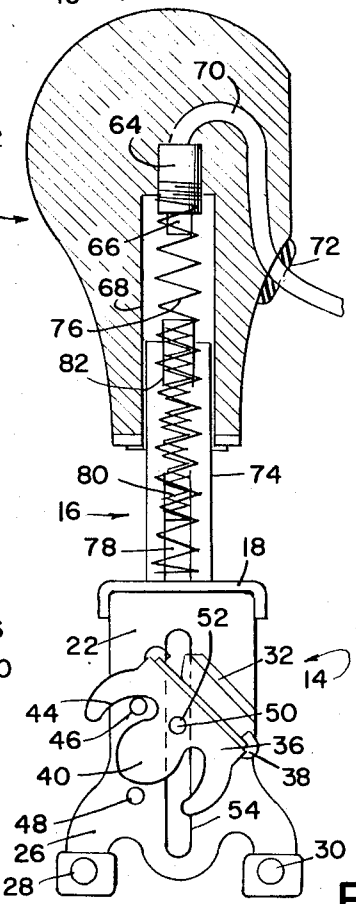
Figure 1A:
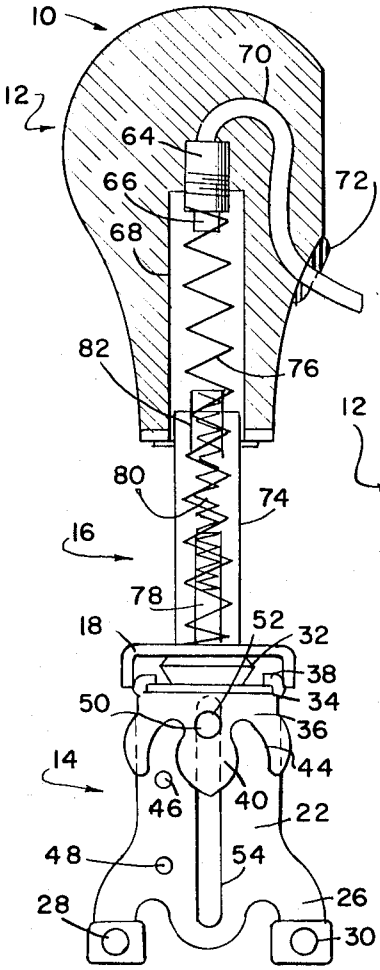

FIG. 1A shows the stamp carriage 36 in the normal or rest position. The carriage 36 is held in this position by a biasing spring which acts on the handle 12 in a manner described later. The face of the stamp 32 abuts an ink pad (not shown) attached to the distal surface of the stamper body end plate 18. The stamp 32 thus receives ink in preparation for its stamping function.

As the handle 12 is moved toward the end plate 18 of the stamper body, the bracket arms 56 and 58 urge the ends of the rod 50 to slide along the slots 54 toward the distal end of the stamper body. The carriage 36 moves with the rod 50 toward the middle of the central chamber 24. The cam surfaces 44 on the carriage 36 engage the upper pins 46, causing the carriage 36 to begin rotation about the rod 50.

Further movement of the handle 12 toward the end plate 18 of the stamper body results in further movement of the carriage 36 toward the distal end of the stamper body. As shown in FIG. 1C, the cam surfaces 44 on the carriage 36 cooperate with the pins 46 and 48 to cause further rotation of the carriage 36 about the rod 50. As shown in the Figure, the carriage 36 is rotated about 90° from its rest position when the rod 50 is in the middle of the slots 54.

FIG. 1D shows the condition of the stamper when the handle 12 reaches the limit of its travel toward the end plate 18 of the stamper body. The carriage 36 has entered the distal end of the stamper body. The cam surfaces 44 on the carriage 36 have cooperated with the lower pins 48 to cause the carriage 36 to rotate 180° from its rest position. The stamp 32 faces the open distal end of the stamper body and projects slightly therefrom into contact with a surface supporting the legs 26 of the stamper body. This is the only time during the stamping operation that the stamp is facing and parallel to the support surface and capable of stamping the support surface. The ink acquired by the stamp 32 in the rest position is transferred to the support surface, placing a mark on the surface which is identical to a pattern formed on the face of the stamp 32.

After the surface is stamped in the manner described above, the handle 12 is moved away from the end plate 18 of the stamper body and the carriage 36 moves sequentially through the positions shown in FIGS. 1C and 1B to the rest position shown in FIG. 1A. The stamp 32 thus returns into contact with the ink pad and receives ink needed for a subsequent stamping.

A careful examination of FIGS. 1A–1D shows that the stamp 32 is positioned entirely within the central chamber 24 at all times except when it reaches the extent of its travel at the distal end of the stamper body. As a result, the stamp is capable of stamping a surface larger than the stamper body only when it has reached its extent of travel at the distal end of the stamper body. The importance of this feature will be more fully appreciated from the description of the counting circuit and switch which follows.

Referring again to FIG. 1A, it can be seen that an electrical switch 64 is mounted in the handle 12. The switch 64 has a push button or other pressure-sensitive element 66 which extends into a hollow longitudinal portion 68 of the handle 12 and faces the end plate 18 of the stamper body. The switch is actuated, i.e., opened or closed, when pressure in excess of a pre-determined minimum is applied to the pressure-sensitive element 66.

An electrical conductor 70 connected to the switch 64 extends through an opening 72 in the side of the handle 12 and is connected to a counting circuit (not shown). The counting circuit is any one of the many well-known circuits which are capable of registering and storing counts. The circuit is advanced by one count each time the switch 64 is actuated.

The plunger assembly 16 includes a hollow cylindrical shaft 74 which extends longitudinally from the stamper body to the handle 12 in alignment with the cylindrical hollow portion 68 of the handle 12. The distal end of the shaft 74 is connected to the center of the end plate 18 of the stamper body and the proximal end of the shaft 74 extends into the hollow portion 68 of the handle 12. A helical spring 76 is concentrically disposed within the shaft 74 and hollow handle portion 68. The spring 76 has a distal end which abuts the proximal surface of the stamper body end plate 18 and a proximal end which is concentrically disposed about the pressure-sensitive element 66 of the switch 64 and which abuts the proximal end of the hollow handle portion 68. The spring 76 thus urges the handle 12 away from the stamper body, thereby biasing the stamp carriage 36 into the rest position shown in FIG. 1A.

A cylindrical post 78 concentrically disposed within the spring 76 has a distal end connected to the center of the stamper body end plate 18. The post 78 extends longitudinally toward the handle 12 and terminates in a distal end positioned within the shaft 74. A second helical spring 80 concentrically disposed within the first helical spring 76 has a distal end connected to the proximal end of the post 78. The spring 80 extends longitudinally from the post 78 in the direction of the switch 64 and terminates in a proximal end spaced slightly beyond the proximal end of the shaft 74. A cylindrical cap 82 concentrically disposed within the first helical spring 76 is fit over the proximal end of the second helical spring 80 and connected thereto. The sides of the cap 82 are concentrically disposed about the second spring 80 and extend into the shaft 74.

The post 78, spring 80 and cap 82 act as a switch actuating mechanism in the manner shown in FIGS. 1A–1D.

When the handle 12 is moved towards the stamper body end plate 18 in opposition to the biasing force of the spring 76, the shaft 74, cap 82, spring 80 and post 78 extend into the hollow handle portion 68. As the handle 12 approaches the extent of its travel, the cap comes into contact with the pressure-sensitive element 66 of the switch 64. Further movement of the handle 12 toward the stamper body end plate 18 causes the cap 82 to apply sufficient pressure to the pressure-sensitive element 66 to actuate the switch 64. The lengths of the hollow handle portion 68, shaft 74, and spring 80 and the elasticity of the spring 80 and the sensitivity of the pressure-sensitive element 66 are coordinated to ensure that the switch 64 is actuated by the time the handle 12 reaches the limit of its travel.

Recalling that the stamp 32 moves into stamping position in the distal end of the stamper body when the handle 12 reaches the limit of its travel, it will be appreciated that the switch 64 is actuated each time the stamp 32 moves into stamping position. Recalling further that the stamp 32 is incapable of stamping a surface larger than the stamper body when it is in any position other than the stamping position, it will be appreciated that the switch 64 is actuated each time the stamp 32 stamps a surface larger than the stamper body.

Figure 3A:
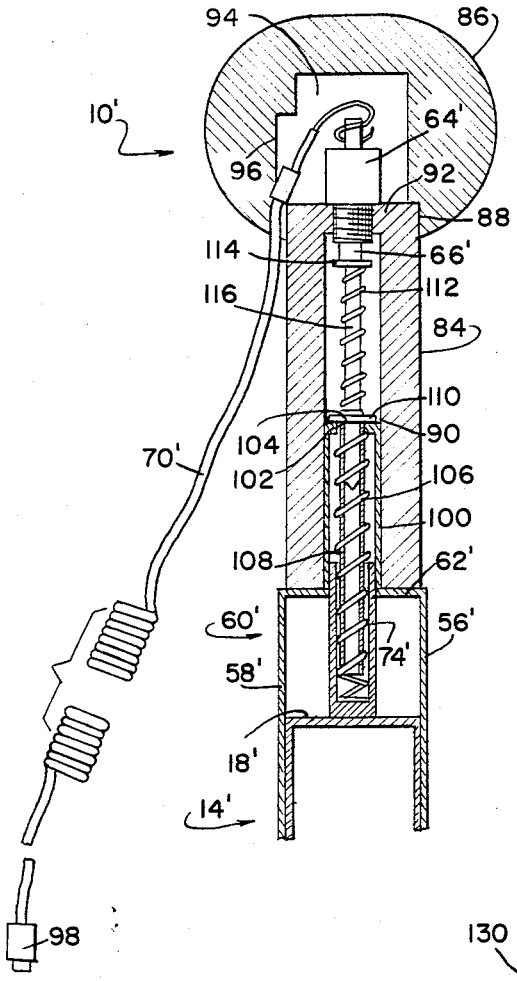
FIGS. 3A and 3B are side elevational views, in section, of another stamping apparatus embodying features of the present invention.
Figure 3B:
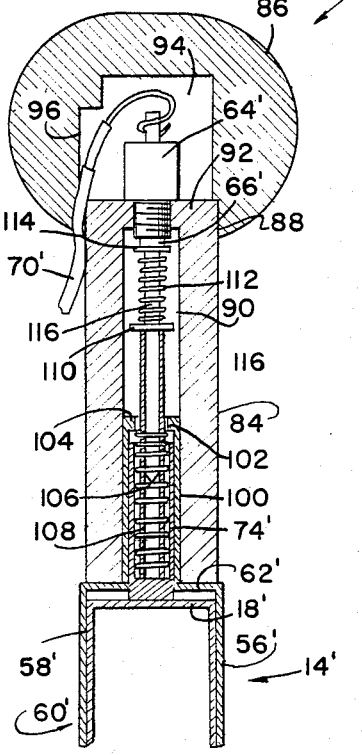

An alternative counting stamper 10' embodying features of the present invention is shown in FIGS. 3A and 3B.

FIG. 3A corresponds to FIG. 1A and shows the alternative counting stamper 10' in the rest position. FIG. 3B corresponds to FIG. 1D and shows the alternative counting stamper 10' in the stamping position. Elements in the alternative stamper 10' which are similar to elements in the stamper 10 have been given the same reference numeral, with a prime added, as the corresponding elements of the stamper 10.

The stamper 10' has a self-inking stamper portion 14' which is identical to the self-inking stamper 14 of the stamper 10. For the sake of simplicity, illustration of the self-inking stamper portion 14' has been largely omitted from FIGS. 3A and 3B.

The handle of the stamper 10' has a longitudinal portion 84 and a bulbous end portion 86. The distal end of the longitudinal portion 84 is connected to a U-shaped bracket 60' which is identical to the U-shaped bracket 60 of the stamper 10. The proximal end of the longitudinal portion 84 fits within an annular shoulder 88 formed in the distal end of the bulbous portion 86.

The longitudinal portion 84 has a hollow cylindrical core 90 which extends from the base 62' of the U-shaped bracket 60' to an end piece 92 formed on the proximal end of the longitudinal portion 94. The switch 64' is mounted in the end piece 92 of the longitudinal portion 84 with the pressure-sensitive element 66' extending into the hollow cylindrical core 90.

The bulbous portion 86 has a hollow center 94 which accommodates the body of the switch 64' and the end of the electrical conductor 70'. A cut-out portion 96 extending through the shoulder 88 provides a space between the bulbous portion 86 and the longitudinal portion 84 which permits the electrical conductor 70' to extend out of the hollow center 94 of the bulbous portion 86 for connection to the counting circuit.

The preferred electrical conductor, as shown in FIG. 3A, is a two-wire coiled stretch cord similar to the type commonly used between the base and the receiver of a telephone. A plug 98, also similar to the type commonly found on a telephone cord, is connected to the end of the conductor 70' remote from the switch 64' to facilitate connection and disconnection from the counting circuit. It will be readily appreciated that this type of conductor and plug can also be used with the stamper 10 shown in FIGS. 1 and 2.

A cylindrical sleeve 100 is concentrically disposed within the core 90 of the longitudinal handle portion 84. The distal end of the sleeve 100 abuts and may be connected to the base 62' of the U-shaped bracket 60'. The proximal end of the sleeve 100 is positioned about midway between the base 62' of the U-shaped bracket 60' and the end piece 92 of the longitudinal handle portion 84 and is provided with a radially inwardly extending annular flange 102 defining a central axial opening 104. A longitudinally extending helical spring 106 is concentrically disposed within the sleeve 100 and the hollow shaft 74' extending from the stamper body end plate 18'. The distal end of the spring 106 abuts the base of the hollow shaft 74' and the proximal end of the spring 106 abuts the flange 102. The spring 106 thus urges the handle away from the stamper body, thereby biasing the stamp carriage into the rest position.

The switch actuating plunger assembly includes a hollow cylindrical post 108 concentrically disposed within the spring 106 and extending longitudinally therethrough. The proximal end of the post 108 extends through the opening 104 defined by the flange 102 and is provided an end plate 110 which rests on the proximal surface of the flange 102 when the stamper is in the rest position. The distal end of the post 108 is spaced slightly from the base of the hollow shaft 74' when the stamper is in the rest position.

A second helical spring 112 extends longitudinally through the handle core 90 between the end plate 110 and the pressure-sensitive element 66' of the switch 64'. The distal end of the spring 112 abuts the end plate 110 and the proximal end of the spring 112 abuts the end plate 114 of a cylindrical shaft 116 which is concentrically disposed within the spring 112 and extends longitudinally therethrough into the post 108. The shaft 116 stabilizes the plunger assembly, particularly the spring 112. The spring 112 urges the end plate 114 of the shaft 116 into abutment with the pressure-sensitive element 66' of the switch 64'.

The manner in which the plunger assembly actuates the switch 64' is best shown in FIG. 3B.

When the handle is moved toward the stamper body end plate 18', the spring 106 is compressed and the shaft 74' extends further into the cylindrical sleeve 100. Further movement of the handle brings the distal end of the post 108 into abutment with the base of the shaft 74'. The shaft 74' and post 108' move in unison thereafter. Further movement of the handle results in further intrusion of the shaft 74' into the sleeve 100' and causes the end plate 110 of the post 108 to lift from the flange 102 and move toward the switch 64'. That movement of the end plate 110 compresses the spring 112 and results in added pressure on the end plate 114 and the pressure-sensitive element 66'. By proper selection and coordination of element parameters, the pressure on the pressure-sensitive element 66' will be sufficient to actuate the switch by the time the handle reaches the limit of its travel. The switch will thus be actuated each time the stamper stamps a large surface.

Figure 4:
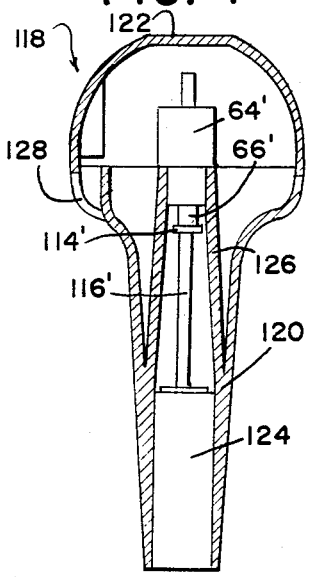
FIG. 4 is a side elevational view, in section, of a handle for yet another stamping apparatus embodying features of the present invention.

FIG. 4 shows an alternative handle structure useable with the plunger assembly shown in FIGS. 3A and 3B. This handle structure is particularly adapted for being formed of molded plastic.

The handle structure, generally indicated by the numeral 118, has two pieces, namely, a longitudinal portion 120 and an end portion 122.

The longitudinal portion 120 has a tapering cylindrical side wall concentrically disposed about a hollow axial core 124. A truncated conical support 126 is positioned in the core 124 and extends longitudinally therethrough. The distal end of the support 126 is connected to the side wall of the longitudinal portion 120 at about the midpoint of the core 124. The switch 64' is mounted on the proximal end of the support 126 and the pressure-sensitive element 66' extends into the hollow interior of the support 126. The plunger shaft 116' extends longitudinally through the support 126 and terminates distally at about the midpoint of the axial core 124.

The proximal end of the longitudinal portion 120 is diametrically enlarged. A notch 128 formed in the enlarged portion allows the electrical conductor to pass between the longitudinal portion 120 and end portion 122 of the handle.

The end portion 122 is a generally dome-shaped element designed to enclose the body of the switch 64' and to mate with the enlarged end of the longitudinal portion 120.

From the foregoing description of the preferred embodiments of the present invention, and from the foregoing discussion of the problems solved thereby, it will be readily apparent to persons of ordinary skill on the art that many other switch configurations are possible within the scope of the present invention. For example, the switch could be embodied in the stamper body itself. Referring to FIGS. 1 and 2, one electrical lead would be connected to one of the side plates 20 and 22 at the distal end of the slot 54 and the other electrical lead would be connected to the rod 50. Appropriate elements in the stamper body would be coated with insulating material so that the rod 50 and the side plate were electrically insulated from each other when the rod 50 was positioned anywhere other than the distal end of the slot 54. When the rod 50 reached the distal end of the slot 54, an electrical contact would be made and the counter would be advanced by one count.

It is preferred that the counting circuit be located remote from the stamping device. This will prevent the user of the stamping device from tampering with the counting circuit.

Figure 6:
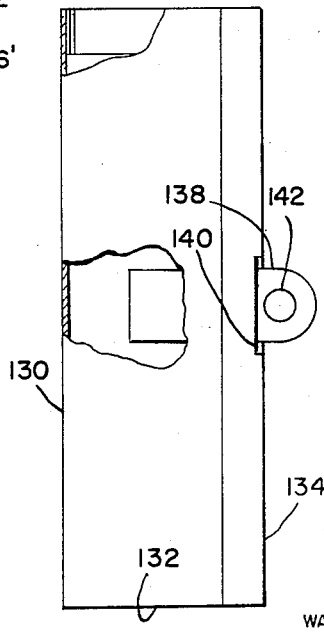
FIG. 6 is a side elevational view of the apparatus shown in FIG. 5.
Figure 5A:
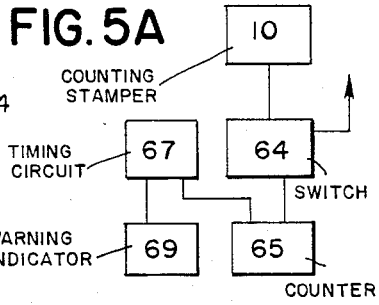
FIG. 5A is a schematic representation of the counter and timing circuits of the present invention.
Figure 5:
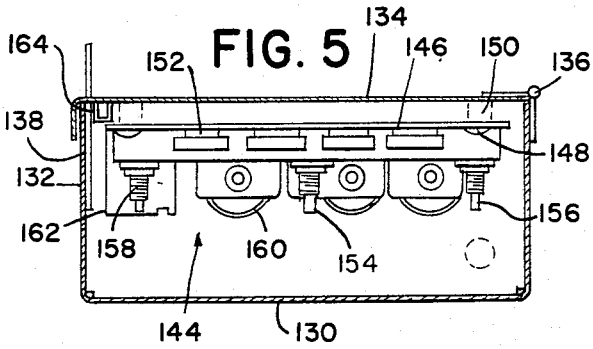
FIG. 5 is an end elevational view, in section, of the lockable box and counting circuitry used with the stamping apparatus of the present invention.

In the preferred embodiment, the counting circuit is mounted in a lockable box located remote from the stamping device. The preferred lockable box and arrangement of the counting circuit in the lockable box is shown in FIGS. 5 and 6.

The box has a rectangular base 130 and four side walls 132 upstanding therefrom. A rectangular lid 134 is connected to one of the side walls 132 by a pivot hinge 136. This allows the box to be opened or closed by pivoting the lid 134.

A tab 138 connected to the inner surface of one of the side walls 132 projects through an opening 140 formed in the lid and extends above the surface of the lid 134. An opening 142 is formed in the portion of the tab 138 above the lid 134. A padlock (not shown) or other suitable locking device is passed through the tab opening 142 when the lid 134 is closed and is then locked to prevent the lid 134 from being opened.

Preferably, the counting circuit 144 is mounted on the inner surface of the lid 134. This permits easy access to the counting circuit 144 when the lid 134 is opened.

As previously mentioned, the present invention can use any known circuit capable of advancing and registering a count upon actuation of a switch. Preferably, the circuit is made up of integrated circuit elements mounted on a circuit board 146. The circuit board 146 is connected to the lid 134 by screws 148 which extend through openings in the circuit board 146 and are received in posts 150 extending from the inner surface of the lid 134.

The circuit preferably has a plurality of display elements 152, such as light emitting diodes, arranged along one edge of the circuit board 146. The display elements present a digital display of the total cumulative count stored by the circuit 144.

It is further preferred that the circuit display 142 be selectively actuated by a switch 154 mounted on the circuit board immediately adjacent the display elements 152. This avoids continuous running of the display elements 152 and thus extends the life of the display elements 152.

It is still further preferred that the counting circuit 144 have a reset feature which is actuated by a switch 156 mounted on one side of the circuit board 146. Actuation of the reset switch 156 resets the counting circuit 144 to a zero count.

It is still further preferred that the counting circuit 144 have a test count switch 158 mounted on the opposite side of the circuit board 146. Manual actuation of the test count switch 158 advances the counting circuit 144 to insure that the circuit 144 is operative.

A source of power for the counting circuit 144, such as a bank of batteries 160, is also preferably mounted on the circuit board 146.

A socket 162 configured to matingly receive the plug 98 on the end of the electrical conductor extending from the stamping device is also mounted on the circuit board 146. A notch 164 formed in a side wall 132 of the box adjacent the lid 134 allows the conductor from the stamping device to pass freely into the interior of the box. The notch 164 preferably has an area which is larger than the cross-sectional area of the conductor but is smaller than the cross-sectional area of the plug 98.

In a further embodiment of the invention, a timing circuit 67 is provided for measuring the length of time that the switch receives continuous actuating pressure. Operation of the timing circuit is illustrated schematically in FIG. 5A. The timing circuit produces a signal when the measured time exceeds a predetermined limit. The signal is communicated to a warning device, such as a light or bell 69, and actuates said device. Alternatively, the signal is communicated to the counting circuit 65 for automatically advancing the count thereof.

Timing circuits capable of performing the function described in the preceding paragraph are well known and would be readily apparent to any person of ordinary skill in the art.

During normal stamping operations, the stamp element should remain in the stamping position for only a brief period of time. The return spring biases the stamp element and urges it to return to the rest position as soon as pressure is released from the handle. When the stamp element remains in the stamping position for an extended period of time, there is a possibility that the person using the stamper is holding the handle against the spring bias, thereby keeping the stamp element in the stamp position and issuing multiple stamps without causing multiple actuations of the switch. Such an activity would defeat the present invention absent the timing circuit. The timing circuit can be arranged to actuate a warning when the stamp is being held in the stamp position so that appropriate corrective action can be taken by a supervisor of the person operating the stamping device. Alternatively, the timing circuit can be arranged to automatically advance the counting circuit by one for each predetermined increment of time that the stamping element is being held in the stamping position, thereby overcoming the attempt to thwart the counting circuit without the need for intervention of a supervisor.

It can now be fully appreciated that the present invention provides a fool-proof counting stamper which insures that a count will be registered in a counting circuit each time a stamp is issued. A stamp can only be issued when the stamping element is moved into the distal end of the stamping device. The stamping element cannot be moved into the distal end of the device without actuating a switch connected to the counting circuit. Hence, an accurate count of stamps given out is assured.

While the invention has been described with reference to specific embodiments, the exact nature and scope of the invention is defined in the following claims.

We claim:

1. Marking and counting apparatus comprising a base having a distal end for resting upon a surface to be marked a proximal portion spaced therefrom, a marking element mounted on the base and moveable with respect thereto, means for moving the marking element, switch actuator means having a portion stationary with respect to the base when the marking element approaches the distal end of the base, a switch mounted for movement with said marking element, said switch being actuated by the actuator means whenever the marking element is moved into the distal end of the base, and counter means connected to the switch for counting the number of times the switch is actuated, and timer means connected to the switch means for timing the duration of the marking element in the distal end of the base and for producing a signal when the duration exceeds a predetermined limit.

2. The apparatus of claim 1 wherein the means for moving the marking element comprises a handle connected to the marking element, said switch being mounted on the handle.

3. The apparatus of claim 2 wherein the handle extends longitudinally from the proximal portion of the base.

4. The apparatus of claim 1 wherein the switch comprises a pressure-actuated switch and the switch actuator means comprises a plunger assembly extending from the base in the direction of the switch for applying actuating pressure to the switch whenever the marking element is moved into the distal end of the base.

5. The apparatus of claim 1 wherein the means for moving the marking element comprises a hollow handle connected to the marking element for movement therewith and extending longitudinally from the proximal portion of the base, the switch comprises a pressure-actuated switch mounted in the handle remote from the base, and the switch actuator means comprises a plunger assembly extending longitudinally from the base toward the handle for extending into the handle and applying actuating pressure to the switch whenever the marking element is moved into the distal end of the base.

6. The apparatus of claim 5 wherein the plunger assembly comprises a post connected to the proximal portion of the base and extending longitudinally toward the handle, a spring connected to the post and extending longitudinally therefrom, and a cap connected to the end of the spring remote from the post for extending into the handle and applying actuating pressure to the switch whenever the marking element is moved into the distal end of the base.

7. The apparatus of claim 6 wherein the marking element is moveable between the distal end and proximal portion of the base and the base is provided with spring means for biasing the marking element into the proximal portion of the base, said spring means comprising a second longitudinally extending spring having a distal end abutting the proximal end of the base and a proximal end extending into the handle and abutting a portion of the handle remote from the base, said second spring being concentrically disposed about the post, the spring and the cap being concentrically disposed within a hollow shaft connected to the proximal end of the base and extending longitudinally therefrom into the handle.

8. The apparatus of claim 5 wherein the plunger assembly comprises a longitudinally extending post having a proximal end and a distal end positioned to abut the base, a longitudinally extending spring having a distal end abutting the proximal end of the post and a proximal end extending into the handle to apply actuating pressure to the switch whenever the marking element is moved into the distal end of the base.

9. The apparatus of claim 8 wherein the proximal end of the spring abuts the switch.

10. The apparatus of claim 8 further comprising a longitudinal shaft extending from the switch into the post and being concentrically disposed within the spring.

11. The apparatus of claim 8 wherein the marking element is moveable between the distal end and proximal portion of the base and the base is provided with spring means for biasing the marking element into the proximal portion of the base, said spring means comprising a second longitudinally extending spring having a distal end supported upon the proximal end of the base and a proximal end extending into the handle and abutting a shoulder formed therein adjacent the proximal end of the post, said second spring being concentrically disposed about the post and being concentrically disposed within a hollow shaft connected to the proximal end of the base and extending longitudinally therefrom into the handle.

12. The apparatus of claim 5 wherein the handle comprises a hollow longitudinal portion for receiving the plunger assembly and a hollow bulbous portion connected to the end of the longitudinal portion remote from the base for housing the switch, said switch having a portion extending into the longitudinal portion for abutment with the plunger assembly.

13. The apparatus of claim 12 wherein the switch is connected to the counter means by an electrical conducter which passes through a space formed between the longitudinal portion and bulbous portion of the handle.

14. The apparatus of claim 1 wherein the marking element is movable between the distal end and proximal portion of the base.

15. The apparatus of claim 14 wherein an ink-impregnated pad is positioned in the proximal portion of the base and the marking element is a stamping block movable between the pad and the distal end of the base for receiving ink from the pad and applying the ink to said surface to be marked.

16. The apparatus of claim 15 wherein the stamping block is constructed and arranged to rotate about an axis transverse to the base as it moves between the pad and the distal end of the base, the stamping block being parallel to said surface to be stamped only when it reaches the distal end of the base.

17. The apparatus of claims 1 or 16 wherein the base is arranged about the marking element to permit the marking element to mark a surface larger than the base only when marking element is positioned in the distal end of the base.

18. Marking and counting apparatus comprising a base having an open distal end and a proximal portion extending longitudinally therefrom, a marking element mounted for reciprocal movement within the base, the base being arranged about the marking element to permit the marking element to mark a surface larger than the base only when the marking element is positioned in the distal end of the base, spring means mounted on the base for biasing the marking element into the proximal portion of the base, means for moving the marking element in opposition to the bias of said spring means to position the marking element in the distal end of the base, and means for automatically counting the number of times the marking element is moved into the distal end of the base comprising switch means which are actuated whenever the marking element moves into the distal end of the base, a counter circuit comprising display elements and a source of power, and conduit means for electrically connecting the switch means to the counter circuit.

19. The apparatus of claim 1 wherein the timer means is further connected to the counter means, said signal being communicated to the counter means for advancing the count thereof.

20. The apparatus of claim 19 wherein the counter means is located remote from the switch.

21. The apparatus of claim 20 wherein the counter means is located in a lockable enclosure.

22. The apparatus of claim 21 wherein the enclosure comprises a base, walls upstanding from the base, and a lid pivotably connected to the walls, said counter means being mounted on an inner surface of the lid.

* * * * *